US008526561B2

(12) United States Patent
Ehst et al.

(10) Patent No.: US 8,526,561 B2
(45) Date of Patent: Sep. 3, 2013

(54) METHODS FOR MAKING AND PROCESSING METAL TARGETS FOR PRODUCING CU-67 RADIOISOTOPE FOR MEDICAL APPLICATIONS

(75) Inventors: David A. Ehst, Downers Grove, IL (US); Delbert L. Bowers, Crest Hill, IL (US)

(73) Assignee: UChicago Argonne, LLC, Chicago, IL (US)

( * ) Notice: Subject to any disclaimer, the term of this patent is extended or adjusted under 35 U.S.C. 154(b) by 595 days.

(21) Appl. No.: 12/462,099

(22) Filed: Jul. 29, 2009

(65) Prior Publication Data

US 2010/0028234 A1 Feb. 4, 2010

Related U.S. Application Data

(60) Provisional application No. 61/137,363, filed on Jul. 30, 2008.

(51) Int. Cl.
*G21G 1/12* (2006.01)
*G21K 5/00* (2006.01)

(52) U.S. Cl.
USPC ..... 376/157; 376/190

(58) Field of Classification Search
None
See application file for complete search history.

(56) References Cited

U.S. PATENT DOCUMENTS 3,419,348 A * 12/1968 Hardy et al. ..... 423/200
5,279,745 A 1/1994 Jeffers et al.
5,784,423 A 7/1998 Lidsky et al.
5,949,836 A 9/1999 Lidsky et al.
6,208,704 B1 3/2001 Lidsky et al.
2003/0016775 A1* 1/2003 Jamriska et al. ..... 376/195
2006/0037438 A1* 2/2006 Holgersen ..... 75/715

FOREIGN PATENT DOCUMENTS

WO WO-2004-075819 A2 * 9/2004

OTHER PUBLICATIONS

Abstract (only) to Fritzler et al, "Electron acceleration beyond 200 MeV inunderdense plasmas unsing table tope laser systems", in "Tenth Workshop, Adavcned Accelerator Concepts", Jun. 2002, Mandaly Beach California (USA).*
Marceau et al., "The Production of Copper 67 from Natural Zinc Using a Linear Accelerator", International Journal of Applied Radiation and Isotopes, vol. 21, pp. 667-669 (1970).*
Fritze, K., "The Preparation of High Specific Activity Copper 64", Radiochimca Acta, vol. 3, pp. 166-167 (1964).*
CRC Handbook of Chemistry and Physics, 92nd Edition, 2011-2012, pp. 12-206 and 12-207.*
"Cyanex 272 Extractant" Brochure from Cytec Industries Inc., Dec. 2002 pp. 1-35.
Mirzadeh, S. et al., Production of No-Carrier Added 67Cu, Appl. Radiat. Isot. vol. 37, No. 1, pp. 29-36, 1986.
Jal, P.K. et al., Chemical Modification of Silica Surface by Immobilization of Functional Groups for Extractive Concentration of Metal Ions, Talanta 62 (2004) 1005-1028.

* cited by examiner

*Primary Examiner* — Johannes P Mondt
(74) *Attorney, Agent, or Firm* — Olson & Cepuritis, Ltd.

(57) ABSTRACT

The present invention provides a method for producing Cu67 radioisotope suitable for use in medical applications. The method comprises irradiating a metallic zinc-68 (Zn68) target with a high energy gamma ray beam. After irradiation, the Cu67 is isolated from the Zn68 by any suitable method (e.g., chemical and/or physical separation). In a preferred embodiment, the Cu67 is isolated by sublimation of the zinc (e.g., at about 500-700° C. under reduced pressure) to afford a copper residue containing Cu67. The Cu67 can be further purified by chemical means (i.e., dissolution in acid, followed by ion exchange).

20 Claims, 5 Drawing Sheets

METHODS FOR MAKING AND PROCESSING METAL TARGETS FOR PRODUCING CU-67 RADIOISOTOPE FOR MEDICAL APPLICATIONS

CROSS-REFERENCE TO RELATED APPLICATIONS

This application claims the benefit of U.S. Provisional Application Ser. No. 61/137,363, filed on Jul. 30, 2008, which is incorporated herein by reference in its entirety.

CONTRACTUAL ORIGIN OF THE INVENTION

The United States Government has rights in this invention pursuant to Contract No. W-31-109-ENG-38 between the United States Government and The University of Chicago and/or pursuant to Contract No. DE-AC02-06CH11357 between the United States Government and UChicago Argonne, LLC representing Argonne National Laboratory.

FIELD OF THE INVENTION

This invention relates to methods and a novel device for producing radioisotopes for medical applications. More particularly, this invention relates to methods and a novel sublimation device for producing Cu67 radioisotope.

BACKGROUND OF THE INVENTION

In recent years medical researchers have indicated a desire to explore radioisotope therapy with beta-emitting sources that may simultaneously be monitored by imaging their photon emission. Beta particles with energies of a few hundred KeV have sufficient range in tissue (millimeters) that they can penetrate small tumor masses, without passing much further into the surrounding body and inadvertently destroying healthy tissue. Gamma rays of a few hundred KeV may be conveniently imaged with external cameras. An isotope that emits both particles must also have appropriate chemical properties in order to attach the isotope to a biologically active agent, such as a peptide or monoclonal antibody. Copper-67 (Cu67) has emerged as one of the most desired of these new radioisotopes; it emits a beta particle of 580 KeV and a gamma ray of 185 KeV. Its half-life of 2.6 days, however, demands rapid production, processing, and transfer to the medical clinic. Therapy of non-Hodgkin's lymphoma is perhaps the most recognized application for Cu67, but the dearth of supply has seriously inhibited the research effort in this area.

Cu67 has been produced by two main processes, i.e., in nuclear reactors in small quantities, for example at Oak Ridge National Lab (ORNL), and by bombardment of zinc oxide (ZnO) with high energy protons.

In the mid 1990s, Cu67 was produced by irradiation of ZnO in DOE-subsidized high-energy physics proton accelerators, e.g., BLIP at Brookhaven National Lab (BNL) and LAMPF at Los Alamos National Lab (LANL). By 2000, DOE changed its focus and emphasized production on the proton cyclotron at TRIUMF, in Canada, with import of the Cu67 to medical researchers in the United States.

Reactor production of Cu67 is particularly difficult for several reasons. For example, neutron flux results in a number of harmful, unwanted other isotopes, which are difficult to remove from the desired Cu67. Human medical treatment applications require non-copper impurities to be reduced to parts-per-billion (ppb) levels, elimination of radioisotopes of copper other than Cu67, and a high specific activity (no more than a few hundred stable copper atoms for each Cu67 atom). In addition, the reactor method needs a sophisticated mechanical rabbit to retrieve the isotope from the core, and radioactive waste handling is costly (frequently requiring subsidization by national governments), which generally hinders economic production of radioisotopes.

Linear accelerator production at BLIP and LAMPF was technically successful, but the two labs simply could not provide enough Cu67 to meet the demand. Production was limited to a total of about 1 Ci per year, due to scheduling demands on the accelerators for high-energy physics missions. Also, proton accelerator production requires irradiation of the target in a vacuum, and the machine must be opened to atmospheric pressure to recover the target, complicating the recovery.

Accordingly, there is an ongoing need for improved methods for producing Cu67, particularly having a purity and specific activity suitable for medical applications. The present invention fulfills this need.

SUMMARY OF THE INVENTION

The present invention provides a photonuclear method for producing Cu67 radioisotope suitable for use in medical applications. The method comprises irradiating a metallic zinc-68 (Zn68) target with a high energy gamma ray beam to convert at least a portion of the Zn68 to Cu67, and then isolating the Cu67 from the irradiated target. The target is irradiated with a gamma ray beam having an intensity of at least about 1.5 kW/cm$^2$, and comprising gamma rays having an energy of at least about 40 MeV. During irradiation, at least a portion of the Zn68 is converted to Cu67 by loss of a proton. Preferably, the irradiation is continued until the conversion of Zn68 to Cu67 yields a Cu67 specific activity of at least about 5 milliCuries-per-gram of target (mCi/g).

In a preferred embodiment, the gamma rays are produced by irradiating a tantalum converter with a high energy electron beam (e.g., about 60 MeV, 6 kW) from a linear accelerator. Preferably, the tantalum is irradiated with a high power electron beam having a beam energy in the range of at least about 40 MeV.

The Cu67 can be isolated from the Zn68 by any suitable method (e.g., chemical and/or physical separation). In a preferred embodiment, the Cu67 is isolated by sublimation of the zinc (e.g., at about 650° C. under vacuum) to afford a copper residue containing Cu67. The Cu67 residue can be further purified by chemical means (e.g., dissolution in acid, followed by ion extraction and/or ion exchange).

The present invention also provides a target holder assembly for irradiating Zn68 with high energy gamma rays to form Cu67. The assembly comprises one or more Zn68 target masses, optionally in a water-tight chamber, the masses or chamber including a plurality of attached cooling fins. The one or more Zn68 target masses are removable from the assembly so that Cu67 can be isolated from the Zn68 after irradiation.

The present invention also provides a titanium apparatus for separation of the irradiated metallic zinc target material from the Cu67 radioisotope.

The present invention provides an improved method for preparing high purity Cu67 for human medical applications compared to conventional processes utilizing nuclear reactors or proton accelerators. In particular, the present method can provide suitable conversions of Zn68 to Cu67 at a much higher production rate (e.g., 10-20 mCi/h or more) than the conventional ZnO method.

The Cu67 produced by the present methods can be linked to biological molecules, such as monoclonal antibodies, which seek out cancer cells (e.g., circulating through the patient's lymph system), thus providing a targeted radiotherapeutic agent. If the Zn68 target material includes a cold (non-radioactive) copper contaminant, then Cu67 isolated from the process will also be contaminated with non-radioactive copper. This is undesirable, since, depending on the level of cold copper in the target, it is possible that most of the antibodies will carry inert copper, with no effect on the cancer. It is therefore highly desirable to utilize a Zn68 target material with as little copper contaminant as is practical, so as to reduce the ratio of cold copper atoms to radioactive Cu67 atoms in the copper recovered from the irradiation process. To that end, the Zn68 target material can be sublimed one or more times to increase its purity, discarding the copper residue remaining after each sublimation. Alternatively, the Zn68 can be purified in any other manner suitable for reducing the copper level in the zinc, e.g., by zone refining.

In one preferred embodiment of the present methods, the Zn68 is recovered after sublimation, and then is reused as an irradiation target, in an iterative fashion, to increase the ratio of Cu67 to non-radioactive copper in the metallic residue produced after each iteration of the process. Typically, during each sublimation, less than about 10% of the small amount of copper in the target material is transferred with the sublimed material. Consequently, after several cycles of target irradiation and processing, the residue of cold copper atoms is reduced to very small numbers. At this point the radioactive Cu67 atoms produced by gamma beam irradiation will be a substantial portion of the total copper recovered for delivery to customers.

BRIEF DESCRIPTION OF THE DRAWINGS

The invention consists of certain novel features and a combination of parts hereinafter fully described, illustrated in the accompanying drawings, and particularly pointed out in various aspects of the invention, it being understood that various changes in the details may be made without departing from the spirit, or sacrificing any of the advantages of the described invention.

DETAILED DESCRIPTION OF PREFERRED EMBODIMENTS

Figure 1:
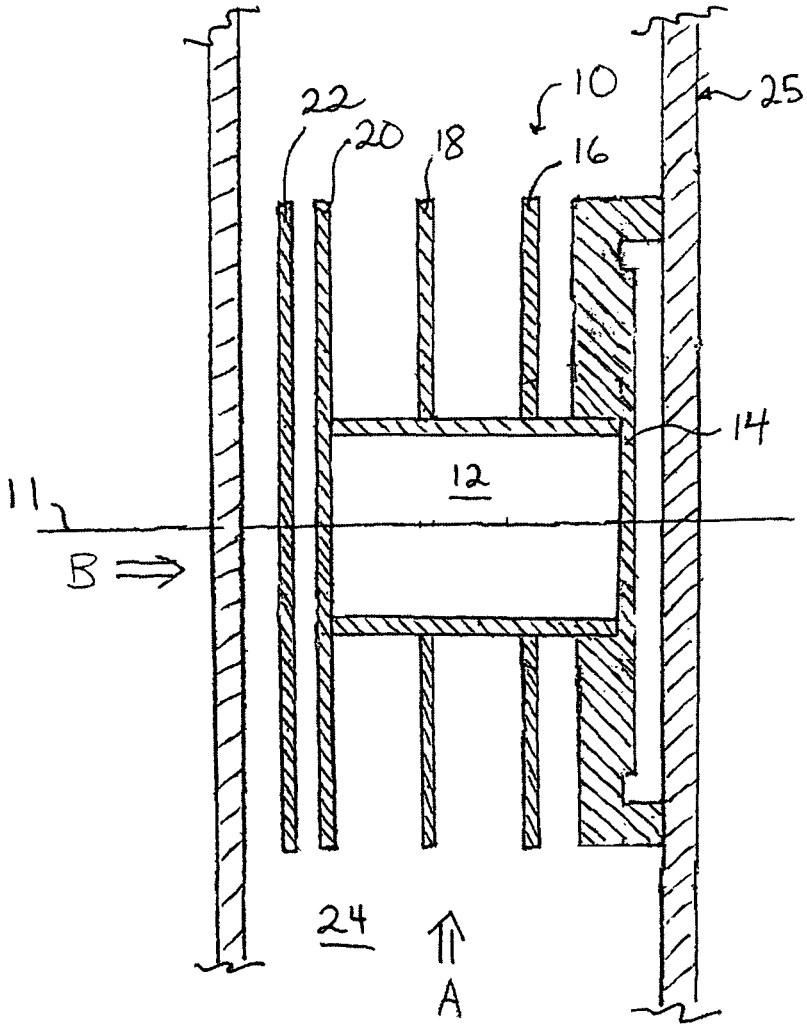
FIG. 1 depicts a schematic cross-sectional representation of a target holder and converter configuration useful in the methods of the present invention.

The present invention provides a method for producing Cu67 radioisotope comprising irradiating a metallic Zn68 target with a high energy gamma ray beam to convert Zn68 atoms to Cu67, and then isolating the Cu67 from the irradiated target.

Preferably, the target to be irradiated comprises at least about 90% Zn68, more preferably at least about 95% Zn68, and even more preferably at least about 99% Zn68. It is particularly preferred that the Zn68 target include as low a level of copper contaminant as is practical, in order to minimize the amount of cold copper recovered after irradiation to produce radioactive Cu67. Zn68 containing low levels of copper can be obtained, for example, by repeated sublimation or by zone refining of the Zn68. At each sublimation stage less than 10% of the small amount of copper in the target material is transferred with the sublimed material, thereby affording a higher ratio of radioactive copper to cold copper after each cycle until substantially all of the copper is depleted from the zinc.

The quantity, Q1, of initial copper in the bulk zinc target can be measured, as can the amount of copper, Q2, left in the sublimed zinc deposit. The metric $r=(Q2/Q1)\times 100\%$ (i.e., the percentage of copper left in the sublimed zinc) is a figure of merit, which provides an assessment of the efficiency the sublimation process for removing trace amounts of copper from the bulk zinc. In three different sublimation runs, the percentage of copper removed from the zinc during sublimation was in the range of 85 to 99.5% (i.e., values of $r=0.5\%$, $r=3.6\%$, and $r<15\%$ were observed). Based on these observations, recycling of the target zinc material will likely reduce trace amounts of cold copper by orders of magnitude after a few sublimation cycles. Thus, utilizing Zn68 that has been repeatedly sublimed (e.g., Zn68 sublimate recovered from repeated runs of the present methods), will lower the level of cold copper present in the Cu67 obtained after irradiation, and thus increase the specific activity of the Cu67 in the copper isolated from the process. The sublimation processing procedure can thus provide an extremely high specific activity of Cu67. For example, the radioisotope Cu67 product supplied to customers can have fewer than ten cold (non-radioactive, stable) copper atoms for each Cu67 atom. This is equivalent to a specific activity of tens to hundreds of kCi/gram of copper.

The Zn68 target can be configured in any suitable and convenient manner. For example, the target can be configured in the form of one or more plates, a solid cylinder, or any other suitable shaped solid mass, and the like. The target can comprise pure zinc metal, or zinc clad in another metal. Any cladding around the Zn68 target is selected so as to avoid contamination of the Zn68 with undesirable metals. Preferably, the cladding is titanium. The target can also be housed in a chamber as desired (e.g., a titanium or aluminum chamber), which is preferably sealable and water-tight. When the Zn68 target is clad or housed in a water-tight chamber, the Zn68 within the cladding or chamber can be a solid plate, cylinder, or other suitable shaped mass. The target preferably has a mass in the range of about 100 to about 200 grams, although smaller and larger targets are suitable, as well.

The Zn68 target is irradiated with a gamma ray beam having an intensity of at least about 1.5 $kW/cm^2$, and comprising gamma rays having an energy of at least about 40 MeV. In a preferred embodiment, the gamma rays are produced by irradiating a tantalum target (Ta converter) with a high energy electron beam (e.g., 60-65 MeV, 6-10 kW) from a linear accelerator. The irradiation produces gamma rays of suitable energy for converting Zn68 to Cu67. Preferably, the tantalum is irradiated with a high power electron beam having a beam energy in the range of about 40 MeV to about 100 MeV and a beam current in the range of about 100 to about 200 microAmperes. Irradiation of the tantalum results in production of gamma rays having an energy in the range of about 40 to about 100 MeV, which is well suited for conversion of Zn68 to Cu67. Preferably, the irradiation is continued until the conversion of Zn68 to Cu67 yields a Cu67 specific activity of at least about 5 milliCuries-per-gram of target (mCi/g), more preferably at least about 10 mCi/g, even more preferably at least about 20 mCi/g. Typical irradiation times are in the range of about 24 to 72 hours.

The tantalum converter preferably has a thickness in the range of about 1 to about 4 mm and can comprise a single plate of tantalum or multiple stacked plates. Alternative converter materials include tungsten (coated with a thin layer of Ta for chemical stability), or heavier metals such as osmium.

The tantalum converter and the Zn68 target can be configured in any suitable manner within the electron beam of the linear accelerator. Due to the inevitable heating of the converter and target, cooling is required during irradiation to avoid failure of the target (e.g., melting). Preferably, the converter and target are cooled by a recirculating cooling system (e.g., immersed in a forced-flow cooling water bath) while in the beam path of the linear accelerator. In a preferred embodiment, the target is mounted in a holder that includes a water-tight target chamber and preferably includes cooling fins in a suitable number and size to aid in dissipating the heat generated during the irradiation. The holder with its included target preferably is immersed within cooling water during irradiation. After irradiation, the linear accelerator is shut down, the cooling water flow is stopped, and the target assembly is removed for processing to recover the Cu67 therefrom.

FIG. 1 shows a schematic cross-sectional representation of one configuration for a converter and target assembly. In FIG. 1, target assembly 10 includes a water-tight cylindrical chamber 12 for housing a cylindrical Zn68 target (not shown), a base 14 at the distal end of chamber 12, and cooling fins 16, 18, 20 arranged perpendicular to axis 11 of chamber 12 and proximate to base 14. Tantalum converter 22 is positioned proximate to cooling fin 20, and spaced therefrom. Assembly 10 is shown immersed in cooling water flow path 24 within cooling bath 25 in a linear accelerator (not shown). Assembly 10 preferably is constructed of titanium or aluminum, most preferably titanium. In the drawing, the direction of cooling water flow is shown by arrow A and the direction of the electron beam of the accelerator is shown by arrow B.

Figure 2:
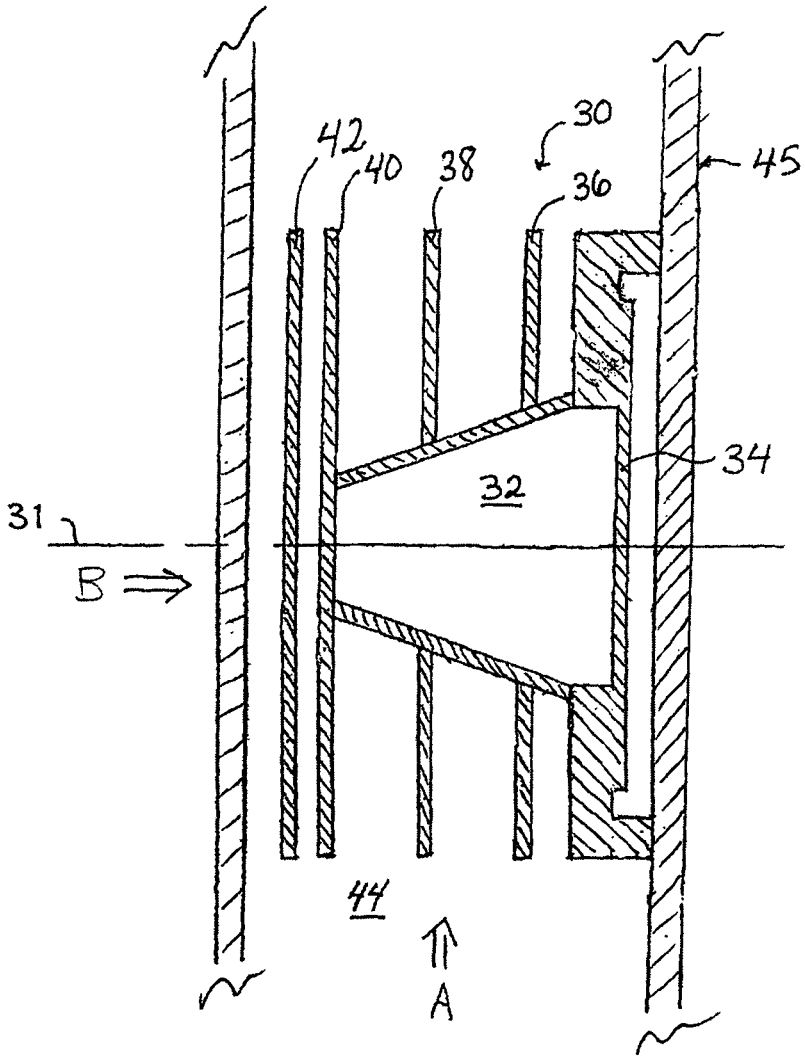
FIG. 2 depicts a schematic cross-sectional representation of an alternative target holder and converter configuration useful in the methods of the present invention.

FIG. 2 shows a schematic cross-sectional representation of an alternative configuration for the converter and the target assembly. In FIG. 2, target assembly 30 includes a water-tight, truncated conical chamber 32 for housing the Zn68 target (not shown), a base 34 at the distal end of chamber 32, and cooling fins 36, 38, 40 arranged perpendicular to axis 31 of chamber 32 and proximate to base 34. Tantalum converter 42 is positioned proximate of cooling fin 40, and spaced therefrom. Assembly 30 is shown immersed in cooling water flow path 44 within cooling bath 45 in a linear accelerator (not shown). Assembly 30 preferably is constructed of titanium or aluminum, most preferably titanium. In the drawing, the direction of cooling water flow is shown by arrow A and the direction of the electron beam of the accelerator is shown by arrow B.

Figure 3:
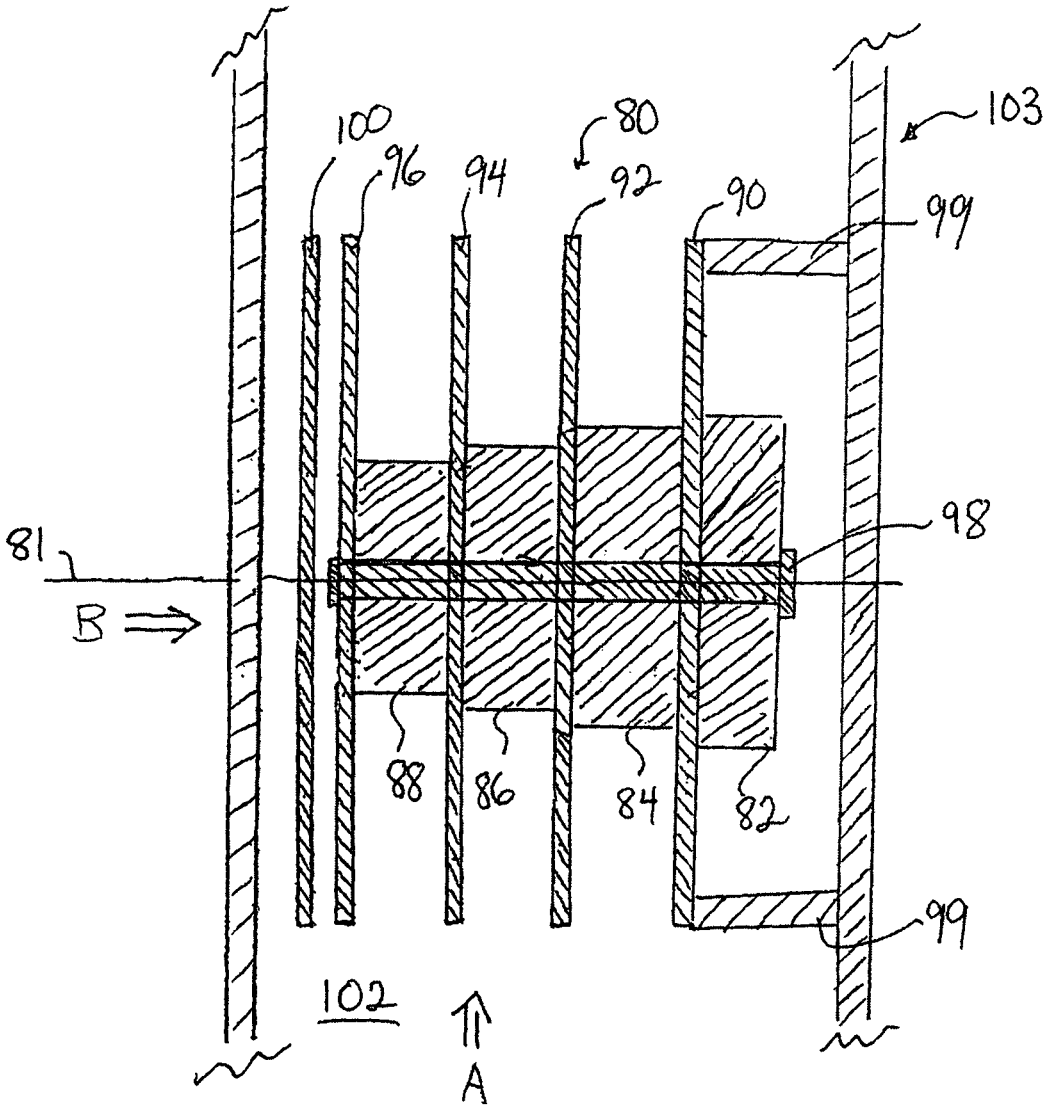
FIG. 3 depicts a schematic cross-sectional representation of another alternative target holder and converter configuration useful in the methods of the present invention.

FIG. 3 shows a schematic cross-sectional representation of another alternative configuration for the converter and target assembly. In FIG. 3, target assembly 80 includes a stack of Zn68 plates 82, 84, 86, and 88, centered along axis 81 of assembly 80. Cooling plates 90, 92, 94, and 96 are bolted together with plates 82, 84, 86, and 88 in an alternating arrangement with cooling plate 96 at the proximal end of the stack (relative to the beam direction) followed in order along the beam path direction by target plate 88, cooling plate 94, target plate 86, cooling plate 92, target plate 84, cooling plate 90, and target plate 82, all attached together by axial bolt 98. Cooling plate 90 is shown mounted within cooling water flow path 102 in cooling bath 103 within a linear accelerator (not shown), by mounting brackets 99. Tantalum converter 100 is positioned proximate to cooling fin 96, and spaced therefrom. Preferably, the cooling plates and bolt are constructed from titanium or aluminum. In the drawing, the direction of cooling water flow is shown by arrow A and the direction of the electron beam of the accelerator is shown by arrow B.

After the Zn68 has been irradiated for a sufficient period of time, the Cu67 produced in the target is isolated from the Zn68 by any suitable method. For example, the metallic target can be reacted with an acid to dissolve the metals and produce a mixture of metal ions (e.g., zinc and copper ions). The metal ions can then be separated from one another by chemical techniques that are well known in the art, including ion extraction, ion exchange, precipitation of insoluble metal salts, and the like. Preferably, the zinc is separated from copper by physical means, e.g., sublimation of zinc. Zinc can be readily sublimed away from copper at an elevated temperature under vacuum. In a preferred embodiment, the Cu67 is isolated by sublimation of the zinc at a temperature in the range of about 500 to about 700° C. under vacuum, preferably at a pressure of about $10^{-3}$ Torr or less (e.g., about $10^{-3}$ to about $10^{-5}$ Torr) to remove a substantial portion of the zinc and afford a residue containing Cu67. In other embodiments, the vacuum pressure can be approximately $10^{-1}$ Torr. Preferably, at least about 90%, 95% or 99% of the zinc is removed by sublimation, more preferably at least about 99.9%, even more preferably at least about 99.99%, on a weight basis. The Cu67-containing residue preferably is further purified by chemical means, such as reaction with an aqueous acid to form a solution of metal ions, followed by ion extraction, ion exchange, or a combination thereof to recover Cu67 ions. The Zn68 sublimate is preferably recycled for use as another target, so as to reduce the level of cold copper contaminant in the Zn68 target with each successive recycle, thus affording a radioactive copper residue containing a higher ratio of Cu67 to non-radioactive copper after each recycle stage, as described above.

Figure 4:
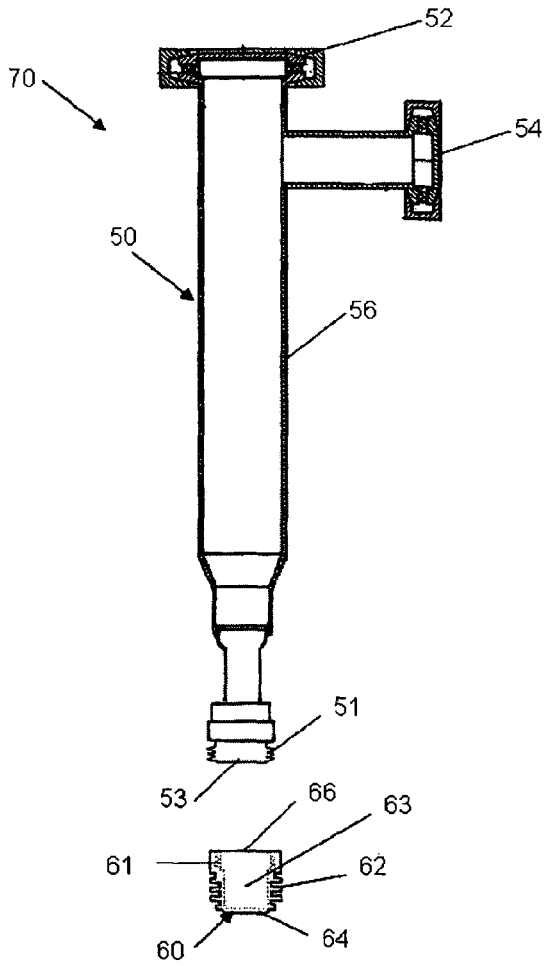
FIG. 4 depicts an exploded representation of a front plan view of the unassembled sublimation apparatus.

After the Zn68 has been irradiated, the Cu67 produced may be isolated from the Zn68 by use of sublimation apparatus 70 as shown at FIG. 4. Sublimation apparatus 70 comprises sublimation body 50 and target capsule 60.

Sublimation body 50 includes hollow tube 56, which is preferably cylindrical. Attached at the distal end of tube 56 is vacuum seal inlet 52. Below vacuum seal inlet 52 is gas coupling 54, which extends perpendicular to tube 56 and is attached thereto. Vacuum seal inlet 52 and gas coupling 54 may each be separately opened and closed with a mechanical lever or other mechanism (not shown). When vacuum seal inlet 52 and gas coupling 54 are closed, a vacuum-tight seal is created between these components and tube 56. The proximal end 53 of tube 56 is threaded for coupling to a target capsule 60. Gas coupling 54 can be attached to a source of inert gas to purge the interior of the tube 56 and capsule 60, if desired, prior to initiating sublimation. Proximal end 53 of tube 56 includes threads 51, for coupling capsule 60 to body 50.

Target capsule 60 is similar to the target capsule disclosed in FIG. 1. Distal end 66 is open, while proximal bottom 64 is closed. Solid cooling fins 62 surround target capsule 60 near its closed proximal bottom 64. In the preferred embodiment, a plurality (e.g. four) of cooling fins is utilized. The number of fins, however, may vary in other embodiments without departing from the spirit of the invention. The inside of hollow target capsule 60 includes a chamber 63, which is preferably cylindrical. In use, a zinc ingot resides within chamber 63. In the preferred embodiment, open distal end 66 of capsule 60 includes threads 61 that are engageable with threads 51 of tube 56 of body 50. In other embodiments, the coupling of body 50 to capsule 60 can be accomplished by any suitable alternative mechanism capable of creating a leak-tight vacuum seal between the components at temperatures of approximately 500 to about 700° C.

In the preferred embodiment, both sublimation body 50 and target capsule 60 are composed of titanium. A Ti—Ti pressure seal between capsule 60 and body 50 is particularly preferred, as this provides a robust seal that can be utilized repeatedly without significant deterioration. In other embodiments, the material of construction of body 50 and target capsule 60 may vary as long as a leak-tight pressure seal is created at high temperatures when the components are attached. Moreover, use of sublimation apparatus 70 is not limited to sublimation separation of Zn68 metal from Cu67 residue.

In a preferred embodiment, the Cu67 residue remaining after zinc sublimation is purified by dissolution in an acid (e.g., a mineral acid such as sulfuric acid, hydrochloric acid, phosphoric acid, nitric acid, or a combination of mineral acids), followed by ion exchange with a copper and/or zinc selective ion exchange resin (e.g., a quaternized amine resin) or a chelating or solvating extractant, preferably immobilized on an ion exchange resin or silica substrate, to afford a Cu67 salt of suitable purity and specific activity for use in human medical applications. In one embodiment, the copper residue is dissolved in hydrochloric acid and the resulting Cu67 ions are purified on a quaternary amine ion exchange resin, as is well known in the art (see e.g., Mirzadeh, et al, *Appl. Radiat. Isot.* 1986; 37(1):29-36).

Suitable metal chelating and solvating extractants are well known in the art and include, e.g., the CYANEX® brand extractants available from Cytec Industries, Inc., West Patterson, N.J., which comprise organophosphorous materials such as organophosphine oxides, organophosphinic acids, and organothiophosphinic acids. Such extractant can be immobilized on resin or silica beads, as is known in the art. See, e.g., U.S. Pat. No. 5,279,745; Kim et al., *Korean Journal of Chemical Engineering,* 2000; 17(1): 118-121; Naik et al. *Journals of Radioanalytical and Nuclear Chemistry,* 2003; 257(2): 327-332; Chah et al, *Separation Science and Technology,* 2002; 37(3): 701-716; and Jal et al., *Talanta,* 2004; 62(5): 1005-1028. The Cu67 recovered after ion exchange typically can be obtained in amounts of up to 100 kCi/g at a purity suitable for human medical use.

The following examples are provided to further illustrate certain aspects of the present invention, and are not to be construed as limiting the invention in any way.

EXAMPLE 1

Photonuclear Production of Cu67 from Metallic Zn68

Photonuclear conversion of Zn68 to Cu67 was achieved on 40-gram targets of natural zinc (about 18.8% Zn68 by mass). The solid metal zinc targets were contained within water-tight titanium cylindrical capsules, sealed with a stainless steel plug. Irradiation runs were performed with electron beam energies in the range of about 36 to 52 MeV; and beam currents that were sufficiently high (up to 220 microAmperes) to provide electron and gamma ray beam powers of up to about 8 kW. The observed yield of Cu67 agreed with the expected value (i.e., about 3 mCi-per 100 microAmpere-hour) under these conditions. Very significantly, the target design was robust (i.e., no target damage was observed) during long, ten-hour, irradiation runs at high power (about 8 kW).

EXAMPLE 2

Separation of Metallic Zinc and Copper by Zn Sublimation

As proof of concept, a metallic Zn—Cu alloy target (about 2.5 g, containing about 2.5% Cu) was placed in a quartz tube and irradiated (with neutrons) to produce a small amount of Cu64, which was used as a tracer to monitor the sublimation efficacy. The resulting irradiated target had an activity for Cu64 of about $2\times10^4$ pCi. The quartz tube was evacuated at a pressure of about $10^{-3}$ Torr and the lower end of the tube, containing the target, was heated in an oven at about 650-660° C. for about 2 hours. Metallic Zn was observed in the upper, cooler part of the tube, but not in the bottom. The contents of the top and bottom of the tube were analyzed. The residue in the bottom of the tube contained copper and a trace of zinc, with a Cu64 activity of about $2\times10^4$ pCi, whereas the top of the tube had no Cu64 activity.

EXAMPLE 3

Sublimation of 23.5 g Zinc Target Ingot

Figure 6:
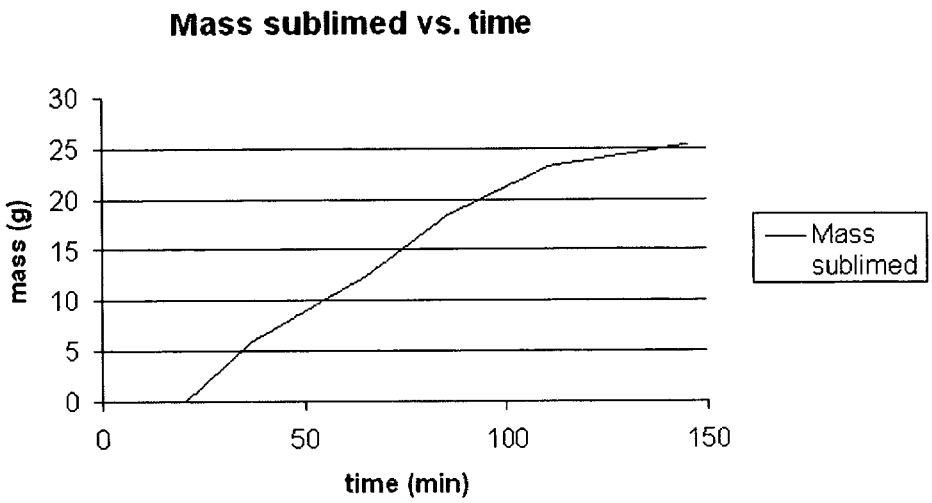
FIG. 6 depicts a graphical representation of zinc mass sublimed vs. time for sublimation of zinc from Cu67 according to the methods of the present invention.

Sublimation separation of the irradiated metallic zinc from the Cu67 radioisotope was achieved on a zinc target ingot having a mass of about 25.3 g. The solid metal zinc target ingot was contained within a vacuum-tight quartz glass tube. The tube was evacuated at a pressure of approximately 0.2 Torr and heated in a furnace at a temperature of approximately 650° C. for about 2.5 hours to sublime zinc away from the Cu67 in the target ingot. A graphical representation of the mass of zinc sublimed versus the time of sublimation is shown in FIG. 6. The rate of sublimation of zinc was greater than 10 g/hour. This rate is a desired goal to economically produce a short half-life radioisotope of Cu67. After sublimation, more than 96% of the Cu67 remained in the solid residue.

EXAMPLE 4

Sublimation of 35.6 g Zinc Target Ingot

An irradiated zinc target ingot having a mass of about 35.6 g in a target capsule similar to the one disclosed in FIG. 1, was placed within a sealed quartz glass tube. The tube was evacuated at a pressure of approximately 0.1 Torr and heated in a furnace at temperature in the range of about 700° C. for approximately 4.5 hours. Approximately 95% of the zinc was sublimed and greater than 88% of the Cu67 radio isotope remained in the sold residue in the capsule at the end of the procedure.

EXAMPLE 5

Sublimation of Zinc Target Ingot in a Titanium Sublimation Tube

Figure 5:
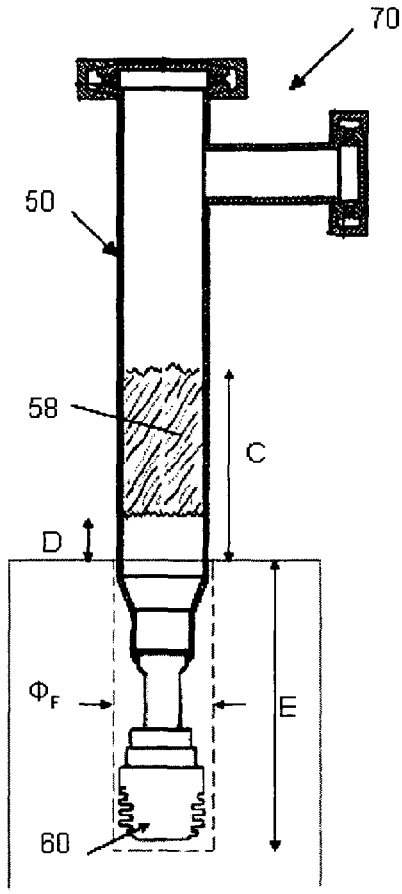
FIG. 5 depicts a front plan view of the assembled sublimation apparatus set into a furnace.

A titanium target capsule of the design shown in FIGS. 4 and 5 containing a zinc ingot (about 13.3 g) was sealed to a titanium sublimation tube of the design shown in FIGS. 4 and 5. As shown in FIG. 5 at E, the target holder 60 and lower portion of the sublimation body 50 were placed into the furnace to heat approximately 12.7 cm of the connected sublimation body 50 and target holder 60. The diameter of the aperture of the furnace as shown at $\phi_F$ was approximately 4.0 cm. The sublimation apparatus was evacuated at a pressure of approximately 0.05 Torr for approximately 7 hours at temperature in the range of about 600° C. Approximately 98% of the zinc was deposited in the cooler deposition zone 58. As shown at D, the distance between the top of the furnace and the bottom of deposition zone 58 was approximately 2.5 cm. While as shown at C, the distance between the top of the furnace and the top of deposition zone 58 was approximately 9.0 cm.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The embodiments of the invention in which an exclusive property or privilege is claimed are defined as follows:

1. A method for producing Cu67 radioisotope comprising irradiating a metallic Zn68 target comprising at least about 90% pure Zn68 with a gamma ray beam generated from high energy electrons in a linear accelerator, the electrons having an energy of at least about 40 MeV and a current of at least about 100 microAmperes to convert a portion of the Zn68 to Cu67, and then isolating Cu67 from the irradiated target by subliming away zinc from the irradiated target at a temperature of at least about 500° C. at a pressure of about $10^{-1}$ Torr or less, to afford a first metallic residue that is substantially zinc-free and contains Cu67.

2. The method of claim 1 wherein the Zn68 target comprises at least about 99% by weight Zn68.

3. The method of claim 1 wherein the Zn68 target is irradiated until the target has a Cu67 specific activity of at least about 5 milliCuries-per gram (mCi/g) of target.

4. The method of claim 1 wherein the gamma rays are generated by bombarding tantalum metal with the high energy electrons.

5. The method of claim 1 further comprising recovering the sublimed Zn68 and repeating the irradiation of the Zn68 to produce a second metallic residue containing a higher ratio of Cu67 to non-radioactive copper than the first metallic residue.

6. The method of claim 1 wherein the zinc is sublimed at a pressure of about $10^{-3}$ Ton or less.

7. The method of claim 1 further comprising reacting the first metallic residue with an aqueous acid to form a solution of metal ions and separation of Cu67 ions from the solution by ion exchange.

8. The method of claim 7 wherein the acid is a mineral acid.

9. The method of claim 8 wherein the mineral acid is selected from the group consisting of hydrochloric acid, sulfuric acid, nitric acid, and phosphoric acid.

10. The method of claim 7 wherein the ion exchange is effected utilizing hydrochloric acid and a quaternary amine ion exchange medium.

11. A method for producing Cu67 radioisotope comprising irradiating a metallic Zn68 target comprising at least about 99% pure Zn68 with a gamma ray beam generated from high energy electrons in a linear accelerator, the electrons having an energy in the range of about 40 to about 100 MeV and a current in the range of about 100 to about 200 microAmperes for a time sufficient to convert a portion of the Zn68 to Cu67 and generate a Cu67 specific activity in the range of about 5 to about 20 milliCuries-per gram (mCi/g) of target, and then isolating Cu67 from the irradiated target by subliming away zinc from the irradiated target at a temperature of at least about 500° C. at a pressure of about $10^{-1}$ Torr or less, to afford a first metallic residue that is substantially zinc-free and contains Cu67.

12. The method of claim 11 wherein the gamma rays are generated by bombarding tantalum metal with the high energy electrons.

13. The method of claim 11 wherein the Zn68 is sublimed at a pressure of about $10^{-3}$ Torr or less, to afford the first metallic residue.

14. The method of claim 11 wherein the zinc is sublimed at a temperature in the range of about 500 to about 700° C. at a pressure in the range of about $10^{-1}$ to about $10^{-5}$ Torr.

15. The method of claim 11 wherein the sublimed zinc is repeatedly recovered and irradiated as a Zn68 target to produce a second metallic residue containing a higher ratio of Cu67 to non-radioactive copper than the first metallic residue during each repetition of recovery and irradiation.

16. The method of claim 11 further comprising reacting the first metallic residue with an aqueous acid to form a solution of metal ions and separation of Cu67 ions from the solution by ion exchange.

17. The method of claim 16 wherein the acid is a mineral acid.

18. The method of claim 17 wherein the mineral acid is selected from the group consisting of hydrochloric acid, sulfuric acid, nitric acid, and phosphoric acid.

19. The method of claim 16 wherein the ion exchange is effected utilizing hydrochloric acid and a quaternary amine ion exchange medium.

20. The method of claim 5 further comprising reacting the first and second metallic residues with an aqueous acid to form a solution of metal ions and separation of Cu67 ions from the solution by ion exchange.

* * * * *

UNITED STATES PATENT AND TRADEMARK OFFICE

CERTIFICATE OF CORRECTION

PATENT NO. : 8,526,561 B2
APPLICATION NO. : 12/462099
DATED : September 3, 2013
INVENTOR(S) : David A. Ehst and Delbert L. Bowers It is certified that error appears in the above-identified patent and that said Letters Patent is hereby corrected as shown below:

IN THE CLAIMS:

Column 10, claim 6, line 12, delete "Ton" and insert --Torr--;

Signed and Sealed this
Twelfth Day of November, 2013

Teresa Stanek Rea

Teresa Stanek Rea
*Deputy Director of the United States Patent and Trademark Office*